US009901239B2

(12) United States Patent
Kücük et al.

(10) Patent No.: US 9,901,239 B2
(45) Date of Patent: Feb. 27, 2018

(54) DISHWASHER, IN PARTICULAR HOUSEHOLD DISHWASHER

(75) Inventors: Cengiz Kücük, Syrgenstein (DE); Johann Schabert, Holzheim (DE); Wilhelm Thibaut, Sontheim (DE)

(73) Assignee: BSH Hausgeräte GmbH, Munich (DE)

( * ) Notice: Subject to any disclaimer, the term of this patent is extended or adjusted under 35 U.S.C. 154(b) by 538 days.

(21) Appl. No.: 13/310,822

(22) Filed: Dec. 5, 2011

(65) Prior Publication Data

US 2012/0153786 A1 Jun. 21, 2012

(30) Foreign Application Priority Data

Dec. 17, 2010 (DE) ..... 10 2010 063 447

(51) Int. Cl.

| | |
|---|---|
| ***A47B 77/06*** | (2006.01) |
| ***A47K 1/04*** | (2006.01) |
| ***A47L 19/02*** | (2006.01) |
| ***E03C 1/18*** | (2006.01) |
| ***A47L 15/42*** | (2006.01) |

(52) U.S. Cl.
CPC ..... *A47L 15/4272* (2013.01); *A47L 15/4268* (2013.01)

(58) Field of Classification Search
CPC ..... A47L 15/4246; A47B 2220/03
USPC ... 312/334.1, 334.4, 228, 257.1, 265.5, 263; 134/56 D, 57 D
See application file for complete search history.

(56) References Cited

U.S. PATENT DOCUMENTS

| | | | | |
|---|---|---|---|---|
| 4,746,177 | A * | 5/1988 | Lampman et al. | 312/228 |
| 5,613,747 | A * | 3/1997 | Becker et al. | 312/278 |
| 5,992,954 | A * | 11/1999 | Becker | 312/228 |
| 6,045,205 | A * | 4/2000 | Dingier | 312/351.7 |
| 6,764,147 | B2 * | 7/2004 | Flowers | 312/228 |
| 6,945,614 | B2 * | 9/2005 | Flowers et al. | 312/228 |
| 7,409,959 | B2 * | 8/2008 | Retsema | 134/56 D |
| 2004/0201334 | A1 * | 10/2004 | Williams et al. | 312/228 |
| 2009/0007944 | A1 * | 1/2009 | Haeberle | 134/201 |
| 2009/0078593 | A1 * | 3/2009 | Patstone | 206/216 |
| 2009/0153003 | A1 * | 6/2009 | Helgesen et al. | 312/228 |
| 2011/0012486 | A1 * | 1/2011 | Fetzer et al. | 312/228 |

FOREIGN PATENT DOCUMENTS

| | | |
|---|---|---|
| DE | 4443918 A1 | 6/1996 |
| EP | 0711527 A1 | 5/1996 |
| WO | 2009068395 A1 | 6/2009 |

OTHER PUBLICATIONS

European Search Report EP 11 19 3066 dated Oct. 20, 2015.

* cited by examiner

*Primary Examiner* — Daniel J Troy
*Assistant Examiner* — Andres F Gallego
(74) *Attorney, Agent, or Firm* — Michael E. Tschupp; Andre Pallapies; Brandon G. Braun

(57) ABSTRACT

A dishwasher, in particular a household dishwasher, includes a washing compartment having a front access opening which is surrounded by a front frame. The front frame is open on a floor side and has lateral frame strips. A base support is arranged on the floor side and has bearing elements for support of the lateral frame strips. Each of the lateral frame strips of the front frame includes at least one hook element which encompasses the associated bearing element of the base support.

26 Claims, 3 Drawing Sheets

DISHWASHER, IN PARTICULAR HOUSEHOLD DISHWASHER

BACKGROUND OF THE INVENTION

The invention relates to a dishwasher, in particular a household dishwasher.

In a dishwasher a firm connection of the components between the washing compartment and a base support arranged below said washing compartment is important in order to distribute forces in an advantageous manner within the dishwasher when a force which is produced as a result of operation or another external force, namely during transport, is introduced.

A dishwasher is disclosed in DE 44 38 085 C2, the washing compartment thereof being surrounded on its front access opening by a front frame which is open on the floor side and welded to the washing compartment. The front frame comprises lateral frame strips which are supported at the front corner regions on hinge plates which in turn are held in the base support on the floor side. The appliance door is pivotably articulated to the hinge plates.

The vertical frame strips of the front frame and the hinge plates are, therefore, connected together at a connection point which serves as a junction point for introducing operating forces or other external forces and which has to withstand said forces. In order, therefore, to configure the connection point with a correspondingly high degree of structural rigidity, both the consumption of materials and the cost in terms of mounting technology are high.

BRIEF SUMMARY OF THE INVENTION

It is an object of the invention to provide a dishwasher, in particular a household dishwasher, in which a simple and yet operationally reliable assembly of the dishwasher is possible.

The object is achieved by the features of claim 1. Preferred developments of the invention are disclosed in the sub-claims.

According to the invention, the front frame enclosing the front access opening of the washing compartment comprises lateral frame strips, which preferably are attached at their lower ends to bearing elements, in particular hinge plates, of a base support on the floor side. Additionally, in the known manner the appliance door is articulated to the hinge plates about a horizontal pivot axis. Each of the frame strips of the front frame comprises at least one hook element which encompasses the bearing element of the base support. By means of the hook element, it is ensured in a simple manner that the respective frame strip remains joined to the associated bearing element, i.e. the hinge plate, and permanently provides a structurally rigid double wall structure. Thus, according to the invention a connection point may be achieved between the front frame and the hinge plate which has a high degree of structural rigidity and dispenses with further separate connecting elements.

According to an advantageous development of the invention, the respective hook element may be configured in the same material and integrally with the respective frame strip of the front frame and, in particular, protrude from a base portion of the frame strip expediently with a hooked projection which merges with an angled hooked limb. Said hooked limb is spaced apart by a clearance from the base portion of the frame strip, forming a centering gap. The centering gap of the hook element in the mounting direction of the washing compartment may be expediently designed, for example, to be downwardly open in the vertical direction. As a result, the hook element is able to encompass the hinge plates when the washing compartment is put in place, whereby said two elements are fixed relative to one another in the lateral direction of the appliance. The clear centering height of the hook element thus preferably corresponds approximately to the wall thickness of the frame strip region encompassed by the hook element.

The invention is explained hereinafter by way of example with reference to a connection point between a frame strip of the front frame and a bearing element designed as a hinge plate. However, it is only of subsidiary importance to the invention that the frame strip is supported on a hinge plate. Instead, the frame strip may be supported on bearing elements of any design.

If the centering gap of the hook element is designed to be downwardly open in the vertical direction, an upper edge of the hinge plate may be directly inserted into the centering gap. The insertion of the hinge plate-upper edge in the centering gap preferably takes place by a positive connection, optionally with slight freedom of movement. As a result, the joining process may be carried out without resilient or plastic deformation of the frame strip or the hinge plate as, for example, would be the case with a latching connection, in which a latching element is able to engage behind an undercut of a mating element only by elastic, resilient deformation.

In the assembled position, the hinge plates are arranged in the lateral direction of the appliance on the outside of the frame strips of the front frame and, in particular, bear flush against the hinge plates. As a result, in the assembled position the washing compartment may be supported without clearance in the lateral direction of the appliance.

The frame strip may preferably comprise at least one height stop via which the front frame is able to be supported on a mating element of the hinge plate. Additionally, the frame strip may additionally comprise a depth stop or separately therefrom preferably at least one depth stop, which may be brought to bear in the overall depth direction against a mating element of the hinge plate. The mating elements formed on the hinge plate of the height stop or depth stop are preferably edges of an aperture-like recess provided in the hinge plate. The height stop or depth stop may preferably protrude outwards, starting from the aforementioned base portion of the frame strips in the lateral direction of the appliance and in the assembled position may be inserted into the respective recess on the hinge plate.

When the washing compartment is still unmounted, the hinge plate may be initially mounted with clearance in the base support. A permanent engagement between the height/depth stop and the recesses of the hinge plate may, therefore, only be ensured by means of the hook element according to the invention which blocks an outward deflection of the hinge plate with clearance in the lateral direction of the appliance. Additional screw connections, which assist a fixed connection of the frame strip to the hinge plate, may be omitted so as to reduce the number of components.

The shape of the frame strip of the front frame is, in particular, designed to be of U-shaped profile with a base portion, already mentioned, as well as edge flanges bent back therefrom. In an advantageous variant of the hook element, at the transition point i.e. in the corner region, a downwardly open centering gap may be provided between the base portion and one of the edge flanges. During assembly, the upper edge of the hinge plate may be inserted into the centering gap and brought to bear against the frame strip-base portion in the lateral direction of the appliance. In order to simplify the assembly further, the downwardly open centering gap may comprise an insertion region with a widened gap width. The chamfered edge defining the insertion region may extend in the vertical direction of the appliance upward in the direction of the base portion, whereby the gap width of the insertion region may be reduced approximately up to a wall thickness of the hinge plate region to be inserted into the centering gap. In particular, the chamfered edge may be contoured in the insertion region of the centering gap such that during assembly the hinge plate is automatically guided to bear flat against the edge strip.

It is preferable if the hook element according to the invention is only provided for positioning the washing compartment in the lateral direction of the appliance, whilst the edge strip itself is supported in-situ on the hinge plate independently of the hook element. In view of this, it may be expedient if in the assembled position the aforementioned hooked projection of the hook element is spaced apart from the upper edge of the hinge plate by a clear height difference.

The advantageous embodiments and/or developments of the invention explained above and/or reproduced in the sub-claims, in this case—apart for example in the case of specific dependencies or incompatible alternatives—may be used individually or also in any combination with one another.

BRIEF DESCRIPTION OF THE DRAWINGS

The invention and the advantageous embodiments and developments thereof, as well as the advantages thereof are explained in more detail hereinafter with reference to the drawings, in which.

DETAILED DESCRIPTION OF EXEMPLARY EMBODIMENTS OF THE PRESENT INVENTION

Figure 1:
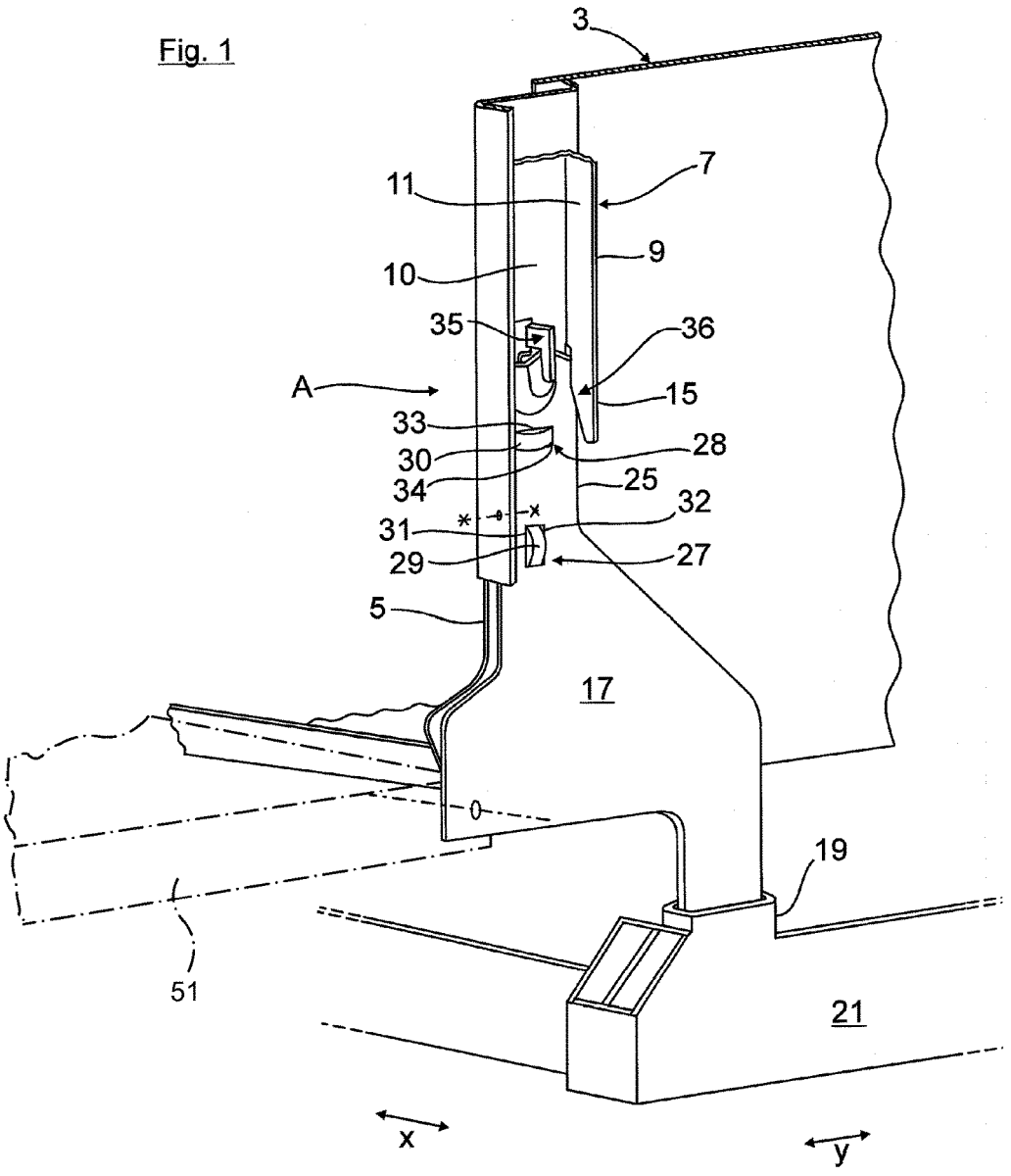
FIG. 1 shows in a perspective principal view the front, right-hand side corner region of a supporting structure of a dishwasher.

In FIG. 1 the lower right-hand side front corner region of a dishwasher is shown in a principal view, the outer housing thereof being omitted and a door 51 shown in broken lines. Additionally, in FIG. 1 appliance components which do not contribute to understanding the invention have also been omitted for the sake of clarity. The left-hand, lower front corner region, not shown, is designed to be mirror-symmetrical relative to a vertical center axis.

Accordingly, the dishwasher comprises a box-shaped washing compartment 3 which may be produced from sheet metal plates welded together and an access opening 5 which is open on the front side and which may be closed by the appliance door. The front access opening 5 of the washing compartment 3 is surrounded in a manner known per se by a front frame 7, which is welded in the manner of a supporting element to the outside of the washing compartment 3. The front frame 7 has vertically arranged lateral frame strips 9 which are connected on the upper face to a transversely extending frame strip. The front frame 7 is designed to be U-shaped in profile with a base portion 10 as well as frame flanges 11 bent back outwardly to the side. The access opening 5 is not completely surrounded by the front frame 7, but instead the lateral frame strips 9 comprise ends 15 which are downwardly open and which are supported on hinge plates 17. Said hinge plates are inserted in each case in a mounting shaft 19 of a trough-shaped base support 21. Additionally, the base support 21 has on its rear corner regions supporting contours, not shown in more detail, which in the rear region carry the washing compartment 3. Moreover, in the lateral direction x of the appliance, hinge levers, not shown, are articulated to both hinge plates 17 on the outside, said hinge levers being mounted on the appliance door.

Figure 2:
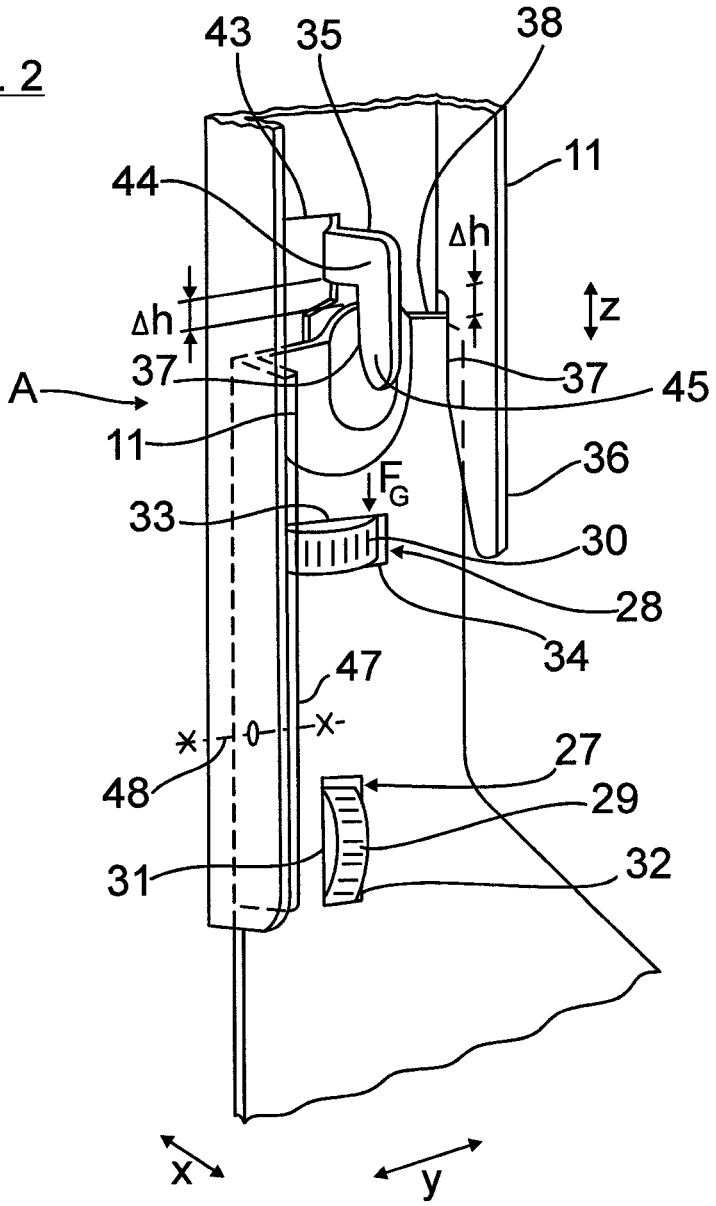
FIG. 2 shows in an enlarged view a connection point between a front frame of the washing compartment and a hinge plate held in the base support.
Figure 3:
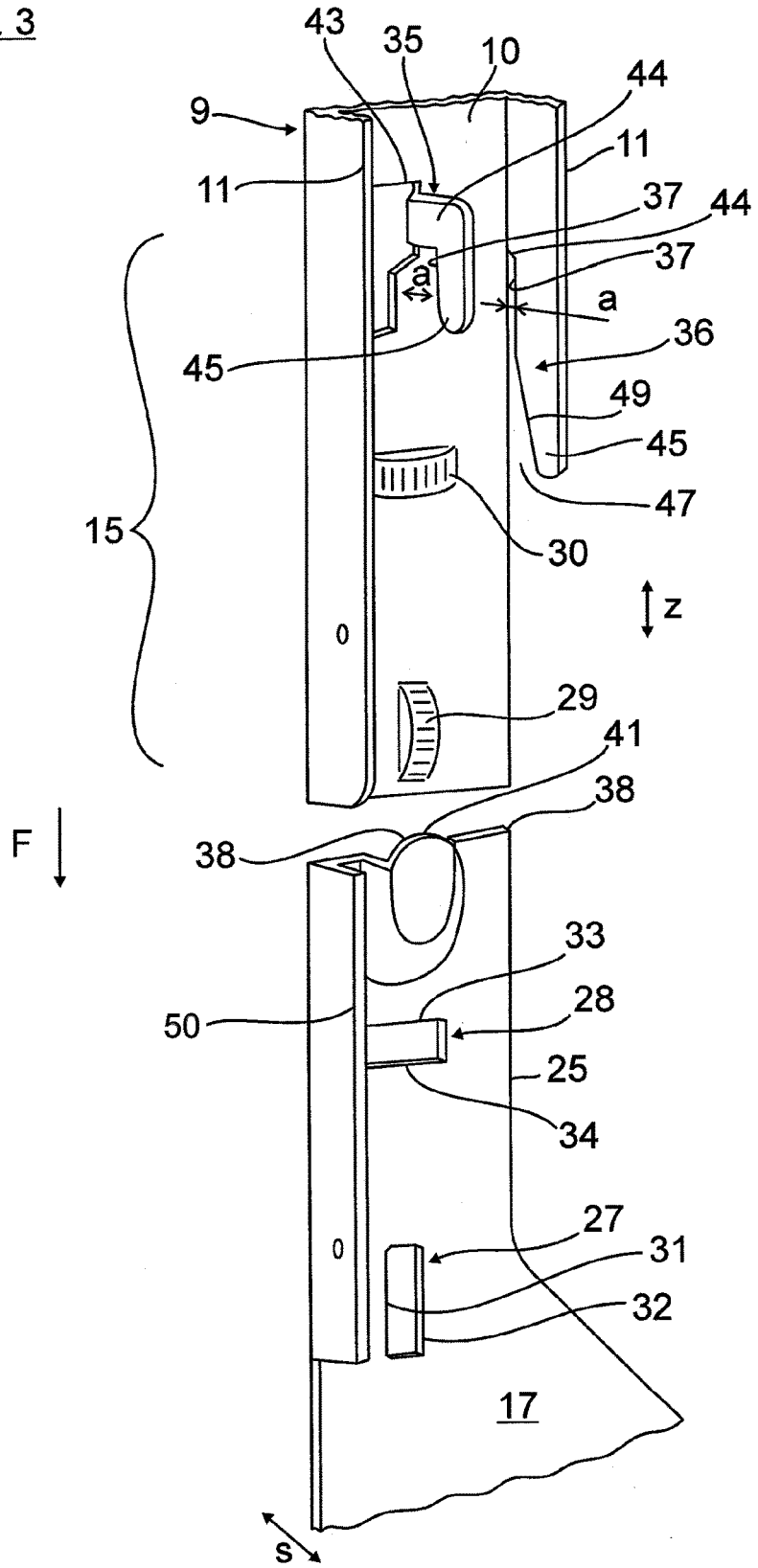
FIG. 3 shows a view according to FIG. 2 but in an exploded view.

In FIG. 2 the connection point A between the frame strip 9 of the front frame 7 as well as the hinge carrier plate 17 are shown enlarged. Accordingly, the hinge plate 17 comprises a limb 25 protruding vertically upward and which is arranged in FIG. 2 between the two edge flanges 11 of the frame strip 9. In the vertical limb 25 of the hinge plate, aperture-like recesses 27, 28 are incorporated, into which in each case a depth stop 29 and a height stop 30 of the frame strip 9 are inserted. The height stop and depth stop 29, 30 are stamped as embossed portions in the base portion 10 of the frame strip 9. According to FIG. 4, the depth stop 29 in this case cooperates in the overall depth direction y with the vertical edges 31, 32 of the recess 27 virtually without play. In contrast, the height stop 30 cooperates with the horizontal edges 33, 34 of the upper recess 28. Accordingly, the washing compartment 3 is supported at the front by its own weight $F_G$ via the two lateral height stops 30 on the lower edge 34 of the recess 28 in the vertical hinge plate limb 25, whereby the weight $F_G$ is introduced into the hinge plate 17. The overlap between the height stop 30 and the lower edge 34 of the recess 28 is relatively small and, depending on the plate thickness, approximately 3 to 7 mm. The same also applies to the overlap provided in the overall depth direction y between the depth stop 29 and the lateral vertical edges 31, 32. In order to ensure a permanent engagement of the height/depth stops here, the lower end 15 of the frame strip 9 is formed with additional hook elements 35, 36, which in each case comprise a centering gap 37 which is downwardly open in the vertical direction z, in which in each case the vertical hinge plate limb 25 is inserted with its upper edge 38. Accordingly, both the hook element 35 and the hook element 36 in each case overlap the upper edge 38 of the vertical hinge plate limb 25. The centering gap 37 is in this case designed so that the vertical hinge plate limb 25 bears tightly against the base portion 10 of the frame strip 9. Accordingly, the clearance a of the hook element 35 shown in FIG. 3 is identical to the contour, predetermined by the cup-like portion 41, on the upper edge 38 and the clearance of the hook element 36 is identical to the wall thickness of the hinge plate 17.

The hook element 35 is an angled sheet-metal flap which is bent out of the cut-out 43 in the base portion 10 of the frame strip 9. Accordingly, the hook element 35 has a hooked projection 44 protruding horizontally outwards approximately at right angles in the lateral direction x of the appliance, which merges with a downwardly angled hooked limb 45. The hooked limb 45 is, as already mentioned above, spaced apart from the base portion 10 of the frame strip 9 by the clearance a. Additionally, the hooked projection 44 is spaced apart from the upper edge 38 of the hinge plate limb 25 in the assembled state by the height difference $\Delta h$, so as not to provide an additional force path for introducing weight forces.

The second hook element 36 of the frame strip 9 is produced by the rear edge flange 11 of the front frame 7 in the overall depth direction y. The edge flange 11 according to FIG. 3 is provided at the transition with the base portion 10 with the centering gap 37, which in the vertical direction z merges downwardly with a widened insertion region 47. The insertion region 47 is defined by a chamfered edge 49 which reduces the gap width, starting from the lower end of the edge flange 11 as far as the centering gap 37 itself.

Additionally, the vertical hinge plate limb 25 at the front comprises a bent-back edge flange 50 which in the installed position (FIG. 1 or 2) is connected by a screw connection 48 to the front frame flange 11 of the front frame 7 in order to ensure grounding. The screw connection 48, however, does not fulfill any centering function and, therefore, does not have any significance for the invention.

In FIG. 3, the frame strip 9 is dismantled from the vertical hinge plate limb 25 shown. When assembling the washing compartment 3 to the base sub-assembly, the front frame 7 is placed in the joining direction F on the vertical hinge plate limb 25. In this case, the upper edge 38 of the hinge plate limb 25 is inserted into the centering gaps 37 of the two hook elements 35, 36. In order to simplify the assembly, a rough alignment of the washing compartment is sufficient relative to the base sub-assembly so that the upper edge 38 of the limb 25 initially strikes against the contact surface 49 in the rear edge flange 11 of the front frame 7 and in a subsequent step is guided thereby to bear against the base portion 10 of the frame strip 17. At the same time, the upper edge 38 is also inserted into the centering gap 37 of the first hook element 35, which is slightly upwardly displaced in comparison with the hook element 36. With this insertion movement, the height stop and depth stop 30, 31 are brought into engagement with the associated recesses 27, 28 in the hinge plate limb 25. As a result, in a manner which is simple in terms of mounting technology, a connection of the washing compartment 3 to the base sub-assembly is produced which results in a structurally rigid front corner region without separate fastening means.

What is claimed is:

1. A dishwasher, comprising:

a washing compartment having a front access opening;

a front frame shaped and dimensioned to surround, at least in part, the front access opening, said front frame being open on a floor side, and said front frame having frame strips;

bearing elements to support corresponding ones of the frame strips; and a base support arranged to support the washing compartment on a floor, the base support configured to support the bearing elements, and the bearing elements extending vertically from the base support, wherein each of the frame strips of the front frame comprises at least one hook element structured to connect each of the frame strips to a corresponding one of the bearing elements of the base support at an upper edge of the corresponding bearing element, wherein a longitudinal axis of each of the frame strips is parallel to a longitudinal axis of the corresponding one of the bearing elements, wherein a vertical limb of each of the bearing elements overlaps an end of a corresponding base portion of each of the frame strips below the upper edge of the corresponding bearing elements when the frame strips are supported on the bearing elements, wherein each of the frame strips comprises at least one height stop to support the front frame on the corresponding bearing element below the upper edge of the corresponding bearing element, and wherein each of the frame strips comprises at least one depth stop to engage the corresponding bearing element in a depth direction below the upper edge of the corresponding bearing element.

2. The dishwasher of claim 1, wherein each of the frame strips of the front frame comprises at least one edge flange bent back from the base portion of the frame strip in a lateral direction relative to the washing compartment.

3. The dishwasher of claim 2, wherein the base portion of each of the frame strips of the front frame defines a transition with the at least one edge flange, and wherein a downwardly open centering gap is provided at the transition to form the at least one hook element.

4. The dishwasher of claim 3, wherein the downwardly open centering gap comprises a widened insertion region with a chamfered edge, said widened insertion region comprising a wedge shape.

5. The dishwasher of claim 4, wherein the chamfered edge of the widened insertion region reduces a gap width of the centering gap approximately up to a wall thickness of the corresponding bearing element inserted into the centering gap.

6. The dishwasher of claim 1, wherein each at least one hook element comprises a hooked projection which merges with an angled hooked limb which is spaced apart by a clearance from the base portion of the corresponding frame strip to form a centering gap.

7. The dishwasher of claim 6, wherein the centering gap of each at least one hook element is downwardly open in a vertical direction for insertion of the upper edge of each of the bearing elements.

8. The dishwasher of claim 6, wherein in an assembled state the hooked projection is spaced apart from the upper edge of each of the bearing elements by a height difference.

9. The dishwasher of claim 1, wherein the at least one height stop is configured to support the front frame on a mating element of the corresponding bearing element.

10. The dishwasher of claim 9, wherein each of the bearing elements is provided with a height recess, said height recess having an edge to define the mating element, and the at least one height stop of each corresponding frame strip is structured to protrude into said height recess.

11. The dishwasher of claim 1, wherein the at least one depth stop is configured to engage a mating element of the corresponding bearing element in a depth direction.

12. The dishwasher of claim 11, wherein each of the bearing elements is provided with a depth recess, the depth recess having an edge to define the mating element, and the depth stop of the corresponding frame strip is structured to protrude into said depth recess.

13. The dishwasher of claim 1, further comprising a household dishwasher.

14. The dishwasher of claim 1, wherein each at least one hook element defines a clearance which corresponds approximately to a wall thickness of a region of each of the bearing elements encompassed by the hook element.

15. The dishwasher of claim 1, wherein the bearing elements are arranged outside of corresponding ones of the frame strips in a lateral direction relative to the washing compartment.

16. The dishwasher of claim 1, wherein each of the frame strips has a U-shaped cross-sectional profile.

17. The dishwasher of claim 1, wherein the bearing elements are positioned with a clearance in a lateral direction relative to the washing compartment and the bearing elements are secured in an assembled state only when the bearing elements are encompassed by the at least one hook element in the lateral direction.

18. The dishwasher of claim 1, wherein the longitudinal axis of each of the frame strips and the longitudinal axis of each of the bearing elements is perpendicular to the floor.

19. The dishwasher of claim 1, wherein the bearing elements are hinge plates, and wherein the dishwasher further comprises a door articulated to the hinge plates about a horizontal pivot axis.

20. The dishwasher of claim 1, wherein a longitudinal axis of each at least one hook element is parallel to the longitudinal axis of each of the frame strips and the longitudinal axis of a corresponding one of the bearing elements.

21. A frame assembly for a household appliance, the frame assembly comprising:

at least one frame strip comprising a hook element;

at least one bearing element; and at least one base support to support the frame assembly on a floor, each at least one base support configured to support a corresponding one of said at least one bearing element, wherein said hook element of each at least one frame strip is configured to engage the corresponding bearing element at an upper edge of the corresponding bearing element, wherein a longitudinal axis of each of the at least one frame strip, a longitudinal axis of each hook element, and a longitudinal axis of each of the at least one bearing element is perpendicular to the floor, wherein a vertical limb of each of the at least one bearing element overlaps an end of a corresponding one of the at least one base portion of each at least one frame strip below the upper edge of the corresponding bearing element when each of the at least one frame strip is supported on the corresponding bearing element, wherein each at least one frame strip comprises at least one height stop to support the frame assembly on the corresponding bearing element below the upper edge of the corresponding bearing element, and wherein each at least one frame strip comprises at least one depth stop to engage the corresponding bearing element in a depth direction below the upper edge of the corresponding bearing element.

22. The frame assembly of claim 21, wherein each hook element comprises a hooked projection which merges with an angled hooked limb which is spaced apart by a clearance from the at least one base portion of a corresponding one of the at least one frame strip to form a centering gap.

23. The frame assembly of claim 22, wherein the centering gap of each hook element is downwardly open in a vertical direction for insertion of the upper edge of each at least one bearing element.

24. The frame assembly of claim 21, wherein each of the at least one bearing element is a hinge plate configured to articulate a door of the household appliance about a horizontal pivot axis.

25. The frame assembly of claim 21, wherein each hook element defines a clearance which corresponds approximately to a wall thickness of a region of the at least one bearing element encompassed by the hook element.

26. The frame assembly of claim 21, wherein a longitudinal axis of each hook element, the longitudinal axis of each of the at least one frame strip, and the longitudinal axis of each of the at least one bearing element are perpendicular to the floor.

* * * * *